US008448944B2

(12) United States Patent
Yang et al.

(10) Patent No.: US 8,448,944 B2
(45) Date of Patent: May 28, 2013

(54) GAME MACHINE

(75) Inventors: I-Chiang Yang, Hemei Town (TW); Tsair-Rong Chen, Changhua County (TW)

(73) Assignees: Feiloli Electronic Co., Ltd., Changhua County (TW); Department of Electrical Engineering, National Changhua University of Education, Changhua County (TW)

( * ) Notice: Subject to any disclaimer, the term of this patent is extended or adjusted under 35 U.S.C. 154(b) by 148 days.

(21) Appl. No.: 13/215,227

(22) Filed: Aug. 23, 2011

(65) Prior Publication Data

US 2013/0049300 A1 Feb. 28, 2013

(51) Int. Cl.
*A63F 7/36* (2006.01)
*A63F 9/00* (2006.01)

(52) U.S. Cl.
USPC ..... 273/138.1; 273/459; 273/460

(58) Field of Classification Search
USPC ..... 273/138.1, 138.2, 440, 445, 446, 273/447, 454, 459, 460
See application file for complete search history.

(56) References Cited

U.S. PATENT DOCUMENTS 7,600,760 B2 * 10/2009 Matsuda et al. ..... 273/447
8,302,966 B1 * 11/2012 Sullivan ..... 273/138.1
2013/0043651 A1 * 2/2013 Chamberlain ..... 273/138.1

* cited by examiner

*Primary Examiner* — Raleigh W Chiu

(57) ABSTRACT

A prize-displaying apparatus includes a wall, two mounts, two boards, two axles and a motor. The wall includes two apertures defined therein. Each mount includes a horizontal section between two vertical sections. Each vertical section of each mount includes an aperture defined therein. Each board includes a sleeve formed thereon. Each axle is inserted in a related aperture of the wall, the apertures of a related mount and the sleeve of a related board. The motor is operatively connected to one of the axles so that the related board can be pivoted between a supporting position where it supports the other board and a releasing position where it leaves and allows the other board to fall.

7 Claims, 6 Drawing Sheets

GAME MACHINE

BACKGROUND OF INVENTION

1. Field of Invention

The present invention relates to a game machine and, more particularly, to a prize-awarding game machine.

2. Related Prior Art

A conventional prize-awarding game machine includes a booth, a slot apparatus and a claw. The booth includes a chamber defined therein for containing prizes, an opening through which the prizes can be released from the chamber, and a chute extending from the chamber to the opening. The slot apparatus is attached to the booth. At least one coin or token must be inserted into the slot apparatus before the claw can be maneuvered to fetch at least one of the prizes and release the prize onto the chute. However, the chance of successfully fetching a prize and releasing the prize onto the chute is low. Very soon, a user could be discouraged from playing with the game machine.

The present invention is therefore intended to obviate or at least alleviate the problems encountered in prior art.

SUMMARY OF INVENTION

It is the primary objective of the present invention to provide a game machine with which a user has a good chance of being awarded a prize To achieve the foregoing objectives, the game machine is equipped with a prize-displaying apparatus. The prize-displaying apparatus includes a wall, two mounts, two boards, two axles and a motor. The wall includes two apertures defined therein. Each of the mounts includes a horizontal section formed between two vertical sections. Each of the vertical sections of each of the mounts includes an aperture defined therein. Each of the boards includes a sleeve formed thereon. Each of the axles is inserted in a related one of the apertures of the wall, the apertures of a related one of the mounts and the sleeve of a related one of the boards. The motor is operatively connected to one of the axles so that one of the boards can be pivoted between a supporting position where it supports the other board and a releasing position where it leaves and allows the other board to fall.

Other objectives, advantages and features of the present invention will be apparent from the following description referring to the attached drawings.

BRIEF DESCRIPTION OF DRAWINGS

The present invention will be described via detailed illustration of the preferred embodiment referring to the drawings wherein.

DETAILED DESCRIPTION OF PREFERRED EMBODIMENT

Figure 3:
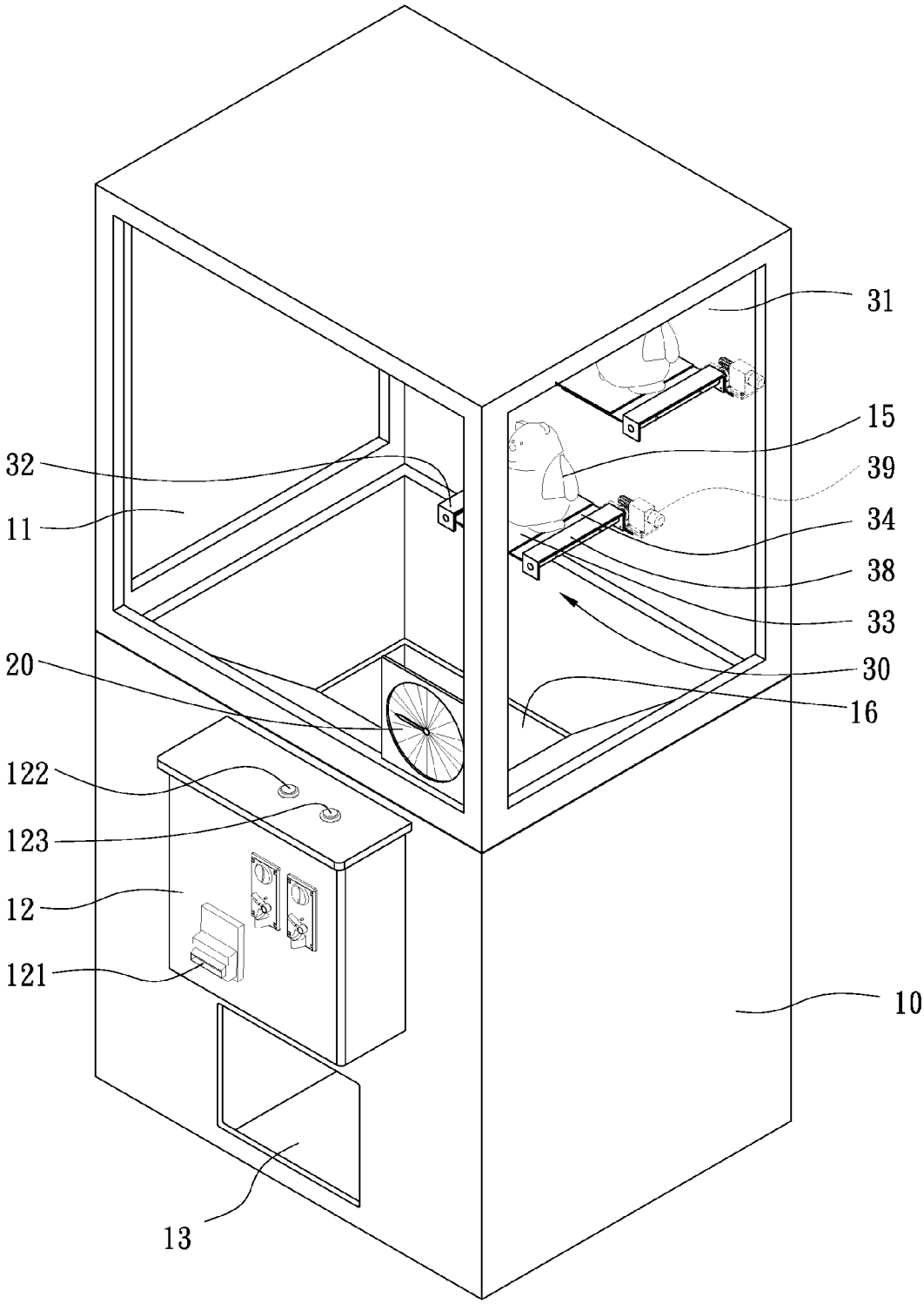
FIG. 3 is a perspective view of a prize-awarding game machine equipped with two prize-displaying apparatuses as the one shown in FIG. 1.

Referring to FIG. 3, there is shown a prize-awarding game machine in accordance with the preferred embodiment of the present invention. The prize-awarding game machine includes a booth 10, a dial 20 and at least one prize-displaying apparatus 30. The booth 10 includes a chamber 11 defined therein for containing at least one prize such as a doll, an opening 13 defined in a front panel thereof below the chamber 11, a chute 16 extending to the opening 13 from the chamber 11, and a slot apparatus 12 attached to the front panel thereof above the opening 13. The slot apparatus 12 includes at least one entrance defined therein, at least one exit 121 defined therein, and two buttons 122 and 123 provided thereon.

Figure 4:
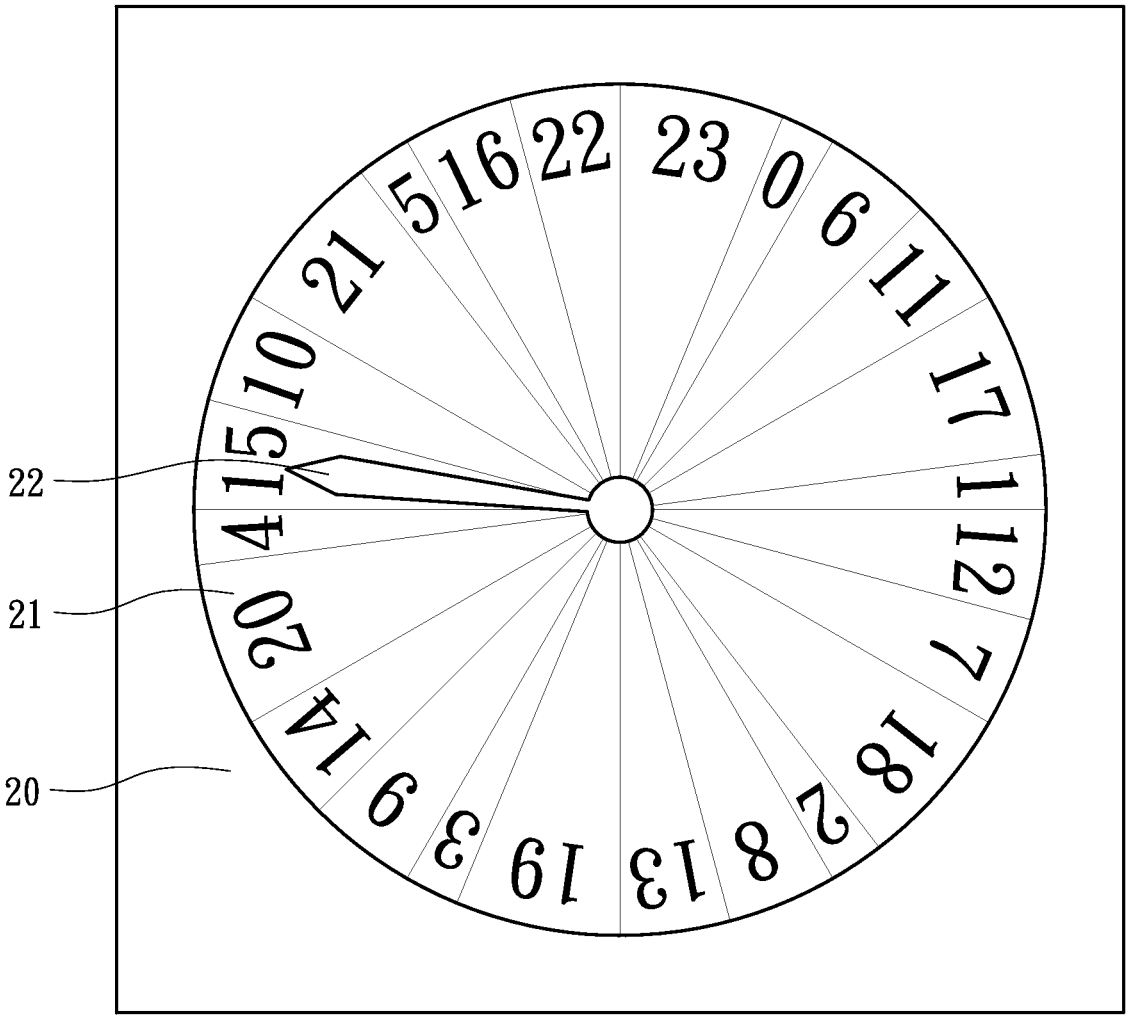
FIG. 4 is a front view of a dial used in the prize-awarding game machine shown in FIG. 1.
Figure 5:
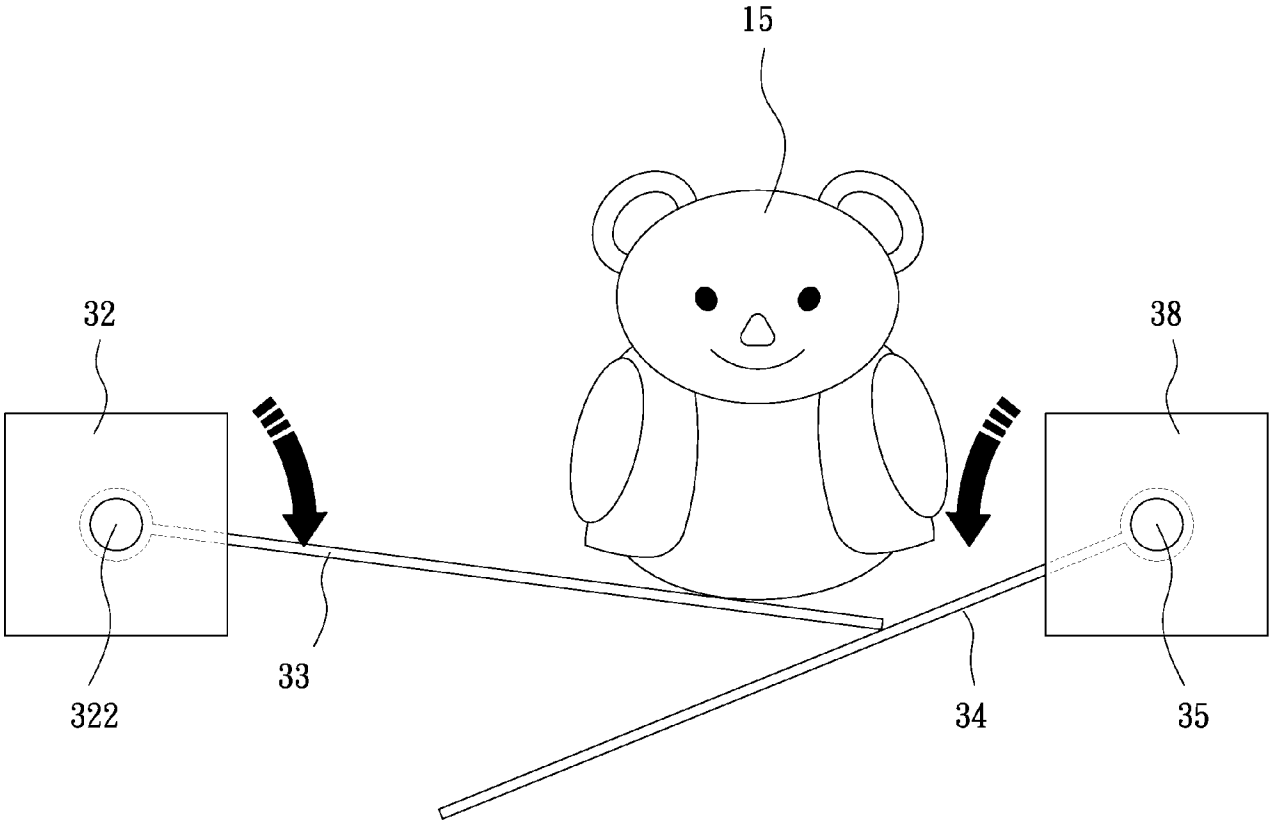
FIG. 5 is a front view of a prize displayed on the prize-displaying apparatus shown in FIG. 2.
Figure 6:
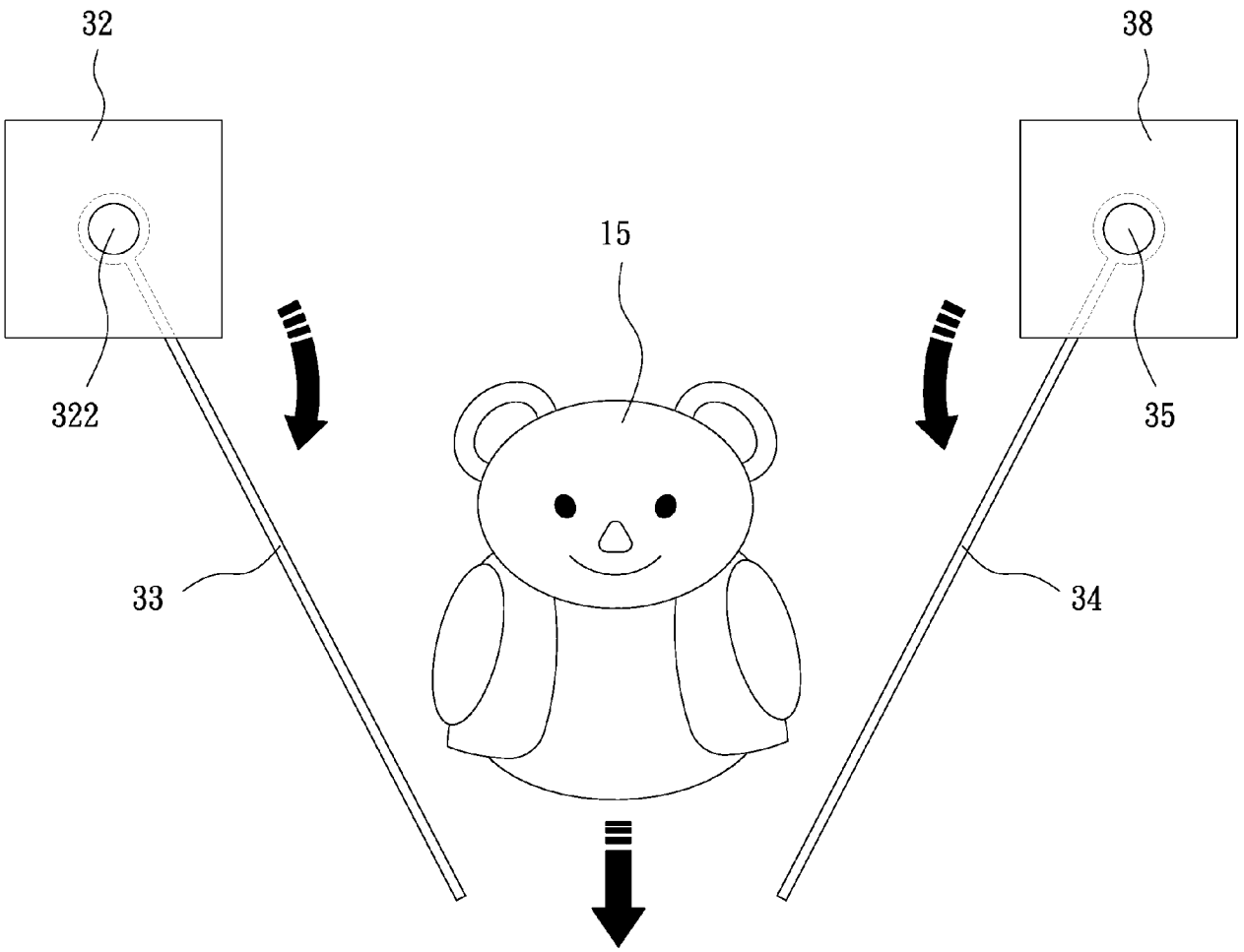
FIG. 6 is a front view of the prize released from the prize-displaying apparatus shown in FIG. 5.

Referring to FIGS. 3 and 4, the dial 20 is located in the chamber 11. The dial 20 includes sectors 21 each marked with a number. A pointer 22 includes a first end connected to a mandrel of a motor (not shown) inserted through the center of the dial 20 and a second end for pointing one of the sectors 21 of the dial 20 to represent a score. The pointer 22 can be spun by the motor.

Intending to play with the prize-awarding game machine, a user inserts a coin or token into the slot apparatus 12 through the entrance. If the user then decides not to play, he or she operates the prize-awarding game machine to release a coin or token from the slot apparatus 12 through the exit 121. After a coin or token is inserted into the slot apparatus 12 through the entrance, the button 122 can be pushed to turn on the motor to spin the pointer 22 while the button 123 can be pushed to turn off the motor to stop the pointer 22.

Figure 1:
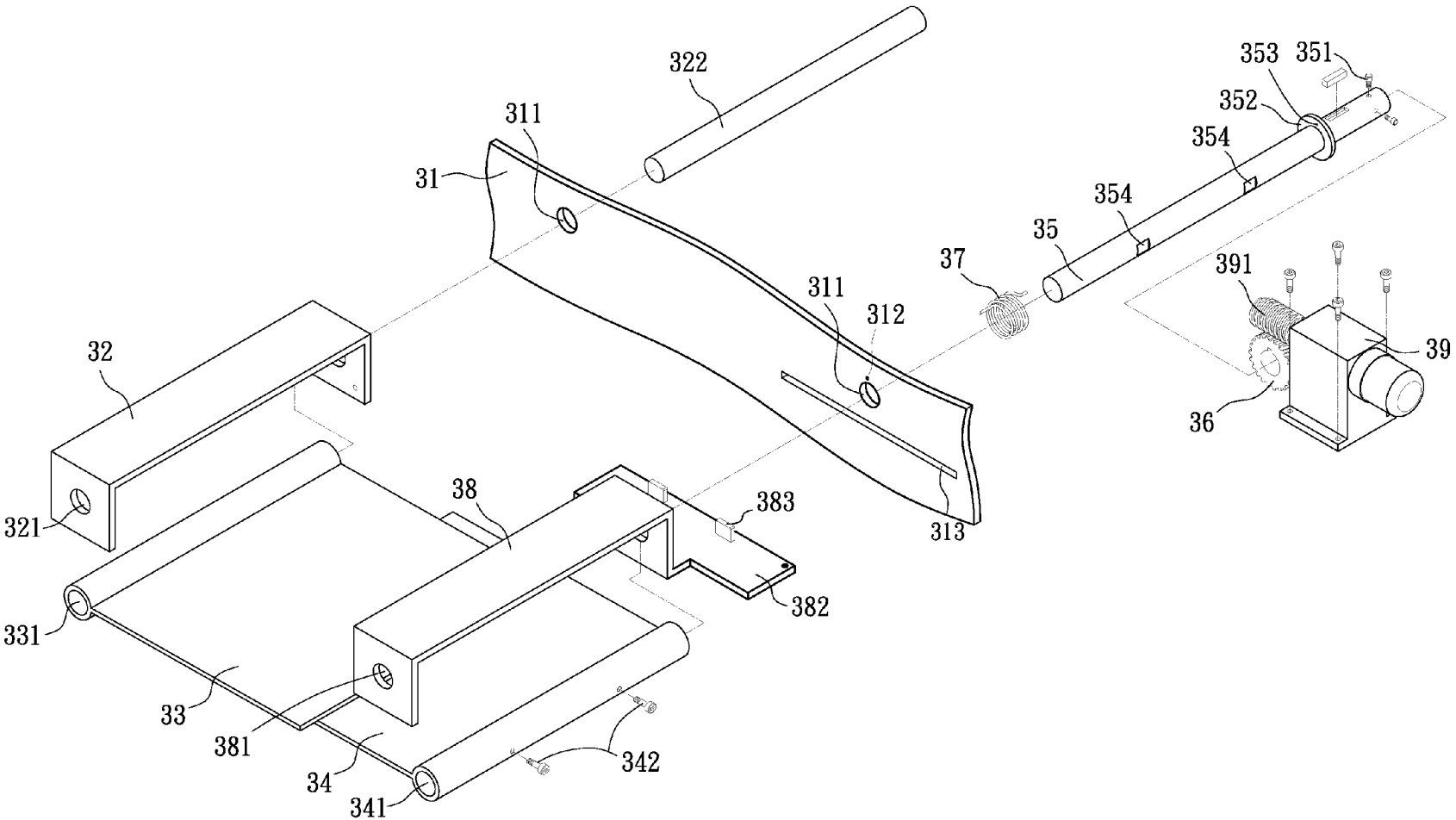
FIG. 1 is an exploded view of a prize-displaying apparatus according to the preferred embodiment of the present invention.
Figure 2:
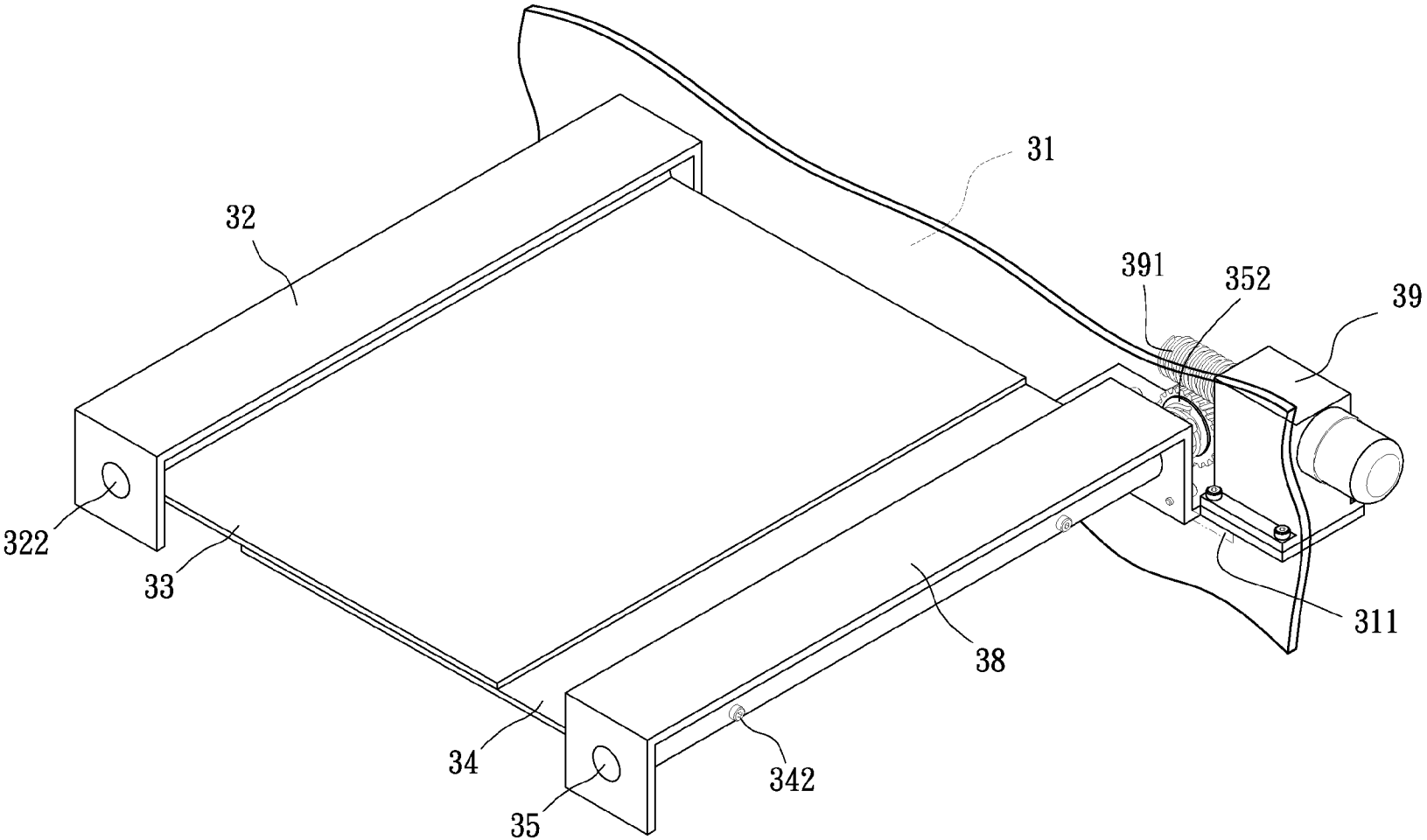
FIG. 2 is a perspective view of the prize-displaying apparatus of FIG. 1.

Referring to FIGS. 1 and 2, the prize-displaying apparatus 30 includes a wall 31, two mounts 32 and 38 connected to the wall 31, two boards 33 and 34, two axles 322 and 35 for connecting the boards 33 and 34 connected to the mounts 32 and 38, a worm gear 36 connected to the axle 35, a worm (nut numbered) engaged with the worm gear 36, and a motor 39 operatively connected to the worm. The wall 31 includes two large apertures 311 defined therein, a small aperture 312 defined therein above one of the large apertures 311, and a slot 313 defined therein.

The mount 32 includes a horizontal section extending between two vertical sections. Each of the vertical sections of the mount 32 includes an aperture 321 defined therein. The first vertical section of the mount 32 is secured to the wall 31.

The mount 38 includes a horizontal section extending between two vertical sections and a platform 382 extending from the first vertical section thereof. Each of the vertical sections of the mount 38 includes an aperture 381 defined therein. The first vertical section of the mount 38 is securely attached to the wall 31. The platform 382 is inserted through the slot 313. Two sensors 383 are supported on the platform 382.

The board 33 includes a sleeve 331 extending along an edge thereof. The sleeve 331 includes a tunnel corresponding to the apertures 321.

The board 34 includes a sleeve 341 extending along an edge thereof. The sleeve 331 includes a tunnel corresponding to the apertures 381.

The axle 322 is inserted in the first large aperture 311 of the wall 31, the apertures 321 and the sleeve 331. Thus, the board 33 is pivotally connected to the mount 32.

The axle 35 includes an annular rib 352 extending thereon, thus dividing the axle 35 into two sections. The annular rib 352 includes an aperture 353 defined therein. Two stems 351 are attached to the first section of the axle 35. The second section of the axle 35 includes two planar faces 354 formed thereon. The second section of the axle 35 is inserted in the second large aperture 311 of the wall 31, the apertures 381 and the sleeve 341 so that the board 34 is pivotally connected to the mount 38. Two screws 342 are driven in two screw holes defined in the sleeve 34 and abutted against the planar faces 354, thus the board 34 can only be spun together with the axle 35.

A helical spring 37 is located around the first section of the axle 35. The helical spring 37 includes an end inserted in the aperture 353 and another end inserted in the small aperture 312.

The worm gear 36 is secured to the first section of the axle 35. The worm is engaged with the worm gear 36. The mandrel of the motor 39 is secured to the worm.

Referring to FIGS. 1 through 6, the operation of the prize-awarding game machine will be described. A prize 15 is displayed on the board 33 and the board 33 is located on the board 34.

At least one coin or token is inserted in the slot apparatus 12 through the entrance. The button 122 is pressed to actuate the pointer 22. Then, the button 123 is pressed to stop the pointer 22. The pointer 22 eventually stops and points in one of the sectors 21. Corresponding to the pointed sector, a score is given. The motor 39 is turned on to pivot (or "tilt") the board 34 via the axle 35 for an angle corresponding to the given score. The angle of the spinning of the axle 35 is measured as the stems 351 are sensed by the sensors 383. The board 33 is pivoted as the board 34 is pivoted. The helical spring 37 is loaded as the axle 35 is spun by the motor 39.

The process discussed in the foregoing paragraph can be repeated. Every time the process is repeated, another score is given and added to the foregoing score or scores and the board 34 is pivoted further. Eventually, the prize 15 will be dropped from the board 33 as the board 33 is dropped from the board 34 if the board 34 is pivoted far enough. Then, the prize 15 will be dropped onto the chute 16 along which the prize 15 will continue to fall. Thus, the prize 15 will eventually fall out of the booth 11 through the opening 13.

Then, the board 33 is returned to the original position manually before the motor 39 is turned on to return the board 34 to the original position through the axle 35. The returning of the board 34 is helped by the helical spring 37. The board 33 is supported on the board 34 again. Finally, another prize is displayed on the board 33.

The present invention has been described via the detailed illustration of the preferred embodiment. Those skilled in the art can derive variations from the preferred embodiment without departing from the scope of the present invention. Therefore, the preferred embodiment shall not limit the scope of the present invention defined in the claims.

What is claimed is:

1. A prize-displaying apparatus including:

a wall including first and second apertures defined therein;

a first mount including two vertical sections and a horizontal section formed between the vertical sections, wherein each of the vertical sections of the first mount includes an aperture defined therein;

a first board including a sleeve formed thereon;

a first axle inserted in the first aperture of the wall, the apertures of the first mount and the sleeve of the first board;

a second mount including two vertical sections and a horizontal section formed between the vertical sections, wherein each of the vertical sections of the second mount includes an aperture defined therein;

a second board including a sleeve formed thereon;

a second axle inserted in the second aperture of the wall, the apertures of the second mount and the sleeve of the second board; and a motor operatively connected to the second axle so that the second board can be pivoted between a supporting position where it supports the first board and a releasing position where it leaves and allows the first board to fall.

2. The prize-displaying apparatus according to claim 1, further including a screw, wherein the second axle includes at least one planar face formed thereon, wherein the screw is driven to the planar face through the sleeve of the second board.

3. The prize-displaying apparatus according to claim 1, further including:

two stems connected to the second axle; and two sensors for sensing the stems, thus measuring the angle of the spinning of the second axle.

4. The prize-displaying apparatus according to claim 3, wherein the second mount includes a platform for supporting the sensors.

5. The prize-displaying apparatus according to claim 1, further including a helical spring for connecting the second axle to the wall.

6. The prize-displaying apparatus according to claim 5, wherein the second axle includes an annular rib formed thereon, wherein the helical spring is connected to the wall at a hand and connected to the annular rib at another end.

7. The prize-displaying apparatus according to claim 1, further including a worm provided on the second axle.

* * * * *